United States Patent [19]

Shead

[11] 4,081,099

[45] Mar. 28, 1978

[54] COLLAPSIBLE CONTAINER

[75] Inventor: Terence H. C. Shead, Chorley Wood, England

[73] Assignee: Worldwide Plastics Development Limited, London, England

[21] Appl. No.: 821,864

[22] Filed: Aug. 4, 1977

[30] Foreign Application Priority Data

Aug. 12, 1976 United Kingdom ..... 33636/76

[51] Int. Cl.[2] ..... B65D 7/24; B65D 5/20; B65D 1/24; B65D 1/48

[52] U.S. Cl. ..... 220/6; 220/71

[58] Field of Search ..... 220/6, 7, 71, 73; 150/.5

[56] References Cited

U.S. PATENT DOCUMENTS

| | | | |
|---|---|---|---|
| 2,144,318 | 1/1939 | Kryder | 150/.5 |
| 3,056,524 | 10/1962 | Stoecker | 220/6 |
| 3,327,896 | 6/1967 | Asenbauer | 220/71 |
| 3,446,415 | 5/1969 | Bromley | 220/7 |
| 3,955,703 | 5/1976 | Zebarth | 220/6 |
| 3,997,07 4 | 12/1976 | Shead | 220/71 |
| 4,044,910 | 8/1977 | Box | 220/6 |

FOREIGN PATENT DOCUMENTS

| | | | |
|---|---|---|---|
| 2,352,533 | 4/1975 | Germany | 220/6 |

*Primary Examiner*—George E. Lowrance
*Attorney, Agent, or Firm*—Sughrue, Rothwell, Mion, Zinn and Macpeak

[57] ABSTRACT

The invention relates to a collapsible container having a base and sides moulded from a synthetic plastics material and including, at least partially encapsulated therein during moulding, elongate metal reinforcing elements. The reinforcing elements of the sides engage with those of the base to provide integral hinges, and include interlock means at the hinges arranged such that when, after initial moulding of the container base and sides in a flat condition, the sides are folded-up, the interlock means prevent return of the sides to the flat condition so that the container may thereafter be collapsed only by folding the sides inwardly over the base.

6 Claims, 14 Drawing Figures

16
D
C
A
B
E
III
IV
VI

COLLAPSIBLE CONTAINER

The invention relates to collapsible containers such as boxes and crates.

With the high cost of materials of all sorts it is very desirable if containers, especially large containers, can be re-used time and time again. Unfortunately, an empty container occupies just as much space as a full container and therefore large amounts of space can be wasted on a return journey which could otherwise have been more productively used. In the past it has been proposed to manufacture nestable containers, but, in order to achieve this object the containers have to have angled sides to permit one container to sit within another. These angled sides mean that space in containers of this type is wasted when the containers are used for rectangular packets or cartons.

Therefore, it has been proposed more recently to manufacture containers which can be collapsed so that they can be more easily transported when empty. Unfortunately, as they require either hinges or other engaging parts to enable the containers to be collapsed, such containers have tended to be complicated in structure. As a result of this, the cost of the container is further increased and this is, of course, extremely disadvantageous.

In order to overcome this problem and in accordance with the present invention, a collapsible container has a base and sides moulded from a synthetic plastics material and including, at least partially encapsulated therein during moulding, elongate metal reinforcing elements, the reinforcing elements of the sides engaging with those of the base to provide integral hinges, and interlocks at the hinges arranged such that when, after initial moulding of the container base and sides in a flat condition, the sides are folded-up, cooperating parts of the interlocks prevent return of the sides to the flat condition so that the container may be collapsed only by folding the sides inwardly over the base.

Such a container can be manufactured in the initial flat condition by injection or compression encapsulation moulding, these processes being well known and simple enough to maintain low costs. The container is constructed so as to collapse only inwards, after initial moulding, because whilst a container which collapses outwardly requires less space than a non-collapsible container, a good deal of space is still wasted when outwardly collapsing containers are packed into lorries as columns of such containers cannot be sufficiently closely packed together.

In one method of forming the integral hinges, the end of a reinforcement element of circular cross-section, in say a side of the container, can be partially flattened and then bent around a similar reinforcing element in say the base of the container. This construction has the advantage of ensuring that maximum use is made of the reinforcing elements of the side in that they are directly connected to the reinforcing elements in the base of the container to provide continuity of reinforcement. An alternate, and preferred method, is to abut the flat ends of the reinforcing element of each side against the curved side of the reinforcing elements of the base and then position a U-shaped flat element around the base element and in alignment with the side element, straddling it and welded to it. This has the advantage that the reinforcing element is not work-hardened during flattening as may be the case in the first method when the end of the side reinforcing element is flattened. Furthermore, as the dimensions of the U-shaped element can be precisely controlled, more easily, its thickness can be less than the curved end of the side reinforcing elements in the first method so that at the hinge points the maximum thickness of the container walls can be reduced.

One example of a container according to the invention, and also a modified hinge arrangement, is shown in the accompanying drawings in which:-

in FIG. 5 with the side in its inwardly collapsed position;

Figure 13:
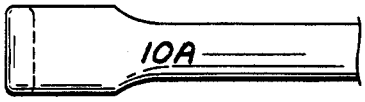
Figure 14:
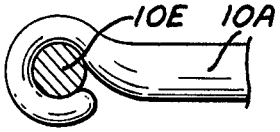

and, FIGS. 13 and 14 show an alternative method of forming the hinges of the sides on the base.

Figures 1, 2:
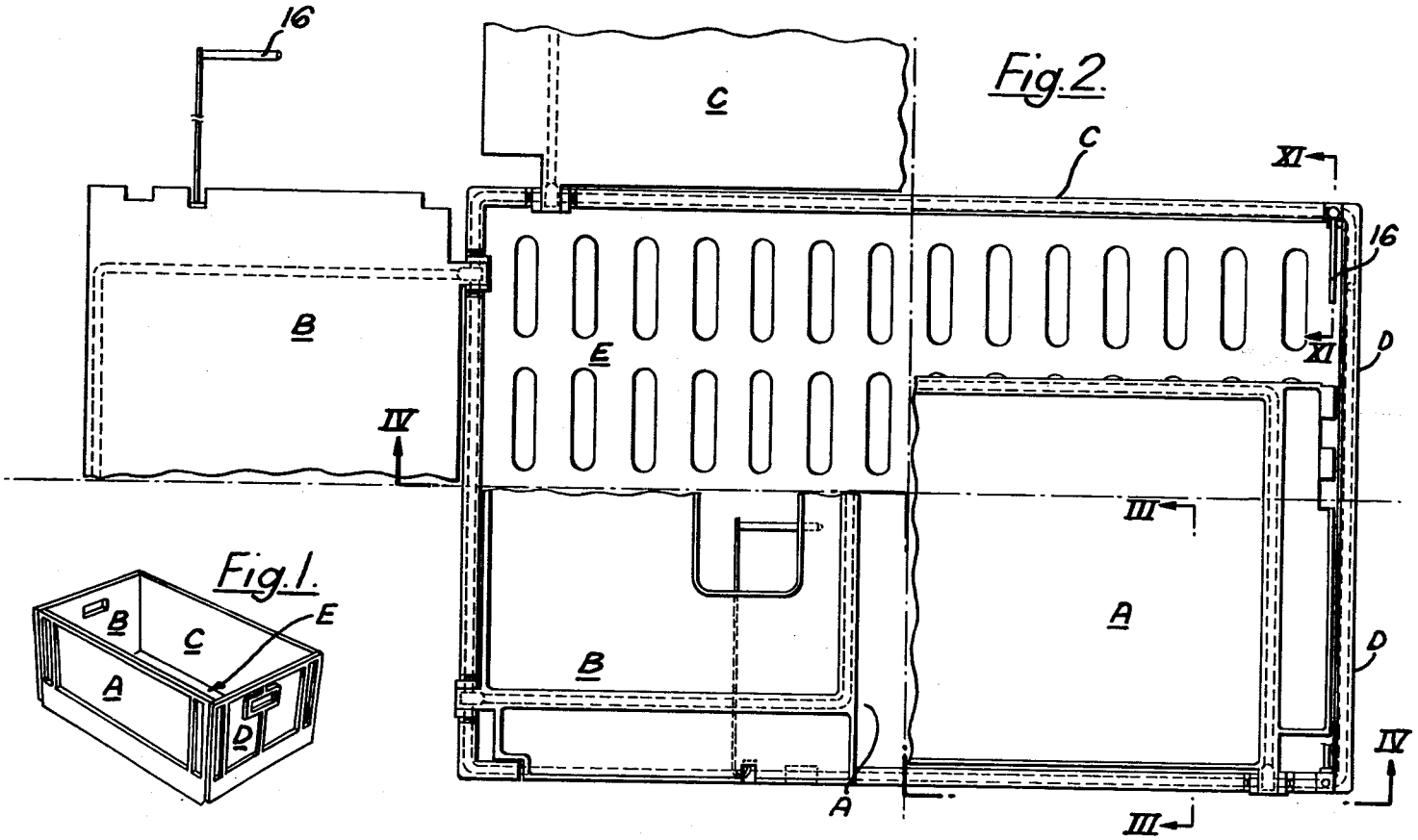
FIG. 1 is a diagrammatic perspective view of the container in its usable configuration.
FIG. 2 is a plan view of the container, showing in its four quadrants, the different positions which the various sides can maintain, both immediately after initial moulding and after the sides have first been folded-up.

In FIG. 1 there can be seen a diagrammatic perspective view of a container, the sides of which are labelled for further reference A, B, C and D and the base labelled E. The container is formed generally from a synthetic plastics material which is internally reinforced both in the walls A, B, C and D and in the base E by steel reinforcing elements 10, the arrangement of which is clearly shown in FIG. 12. The base reinforcing element 10 comprises a rectangular loop having two pairs of identical sides 11 and 12. As can most clearly be seen from the section shown in FIG. 4 the sides 11 are cranked, as shown at 13 and 14 so that the side reinforcing elements 11 lie generally below the side reinforcing elements 12 of the base.

The side reinforcing elements 10 A, B, C and D are generally U-shaped and are attached to the sides of the base reinforcement loop by means of U-shaped flat elements 15 which are more clearly seen in FIG. 5, 6, 7 and 8.

Figure 12:
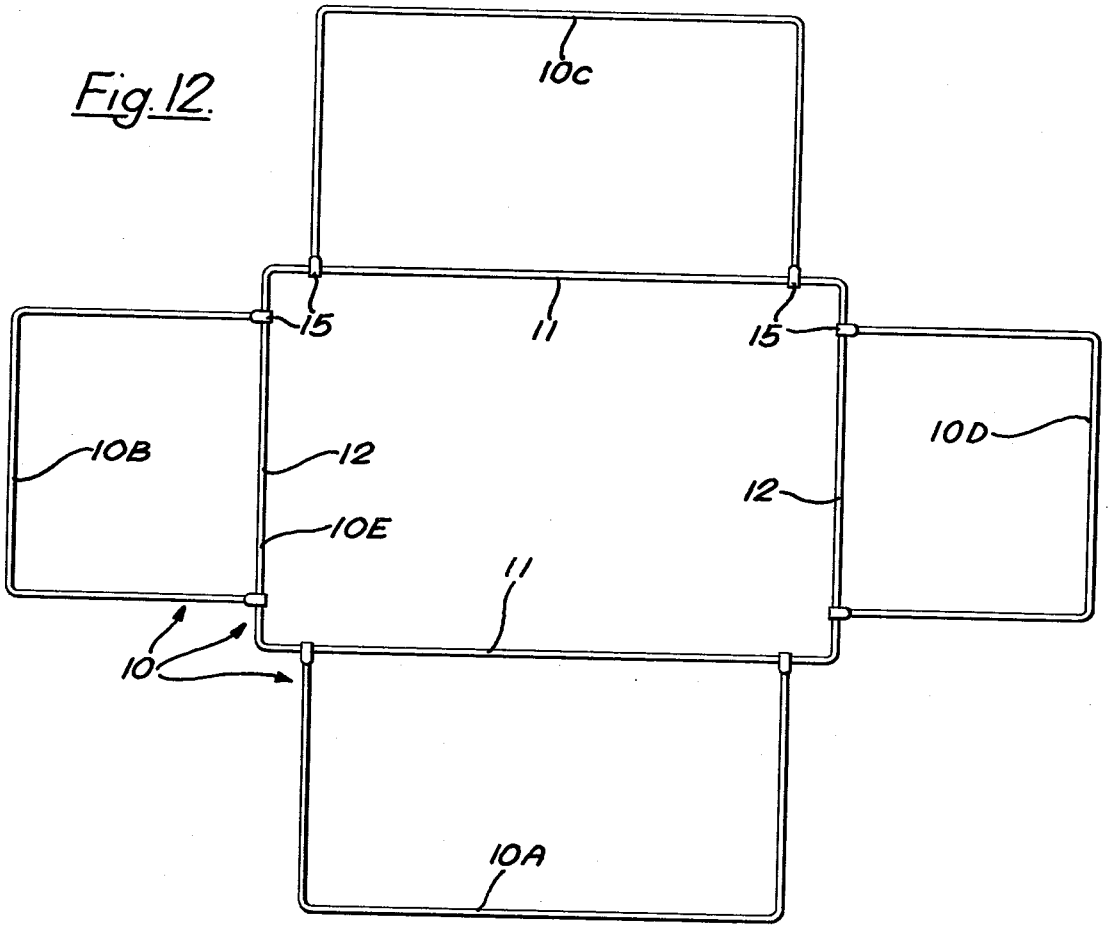
FIG. 12 is a plan view of the reinforcing elements used in the container when laid in their flat condition, that is to say in the position in which the container would be moulded.

The container is preferably formed by an injection or compression moulding technique in which the reinforcement elements 10 are positioned in the mould in the configuration shown in FIG. 12, and around which synthetic plastics material is moulded so as to completely encapsulate the steel reinforcing elements so as to avoid corrosion of the reinforcing elements.

In FIG. 2 in the top left hand quadrant the sides B and C are shown in the positions which they would occupy in the mould, that is to say laid out substantially flat with the base. Of course, they are not completely flat with the base as can be seen from the sections in FIGS. 3 and 4. In the upper part of the top right-hand quadrant of FIG. 2 the sides C and D are shown in their assembled position, that is to say the position that they would occupy when the crate is being used. Elongate studs 16 may be used to maintain the sides in their assembled positions, although, of course, other devices such as snap catches etc. could be employed. In the bottom right hand quadrant of FIG. 2 the side D is shown in its assembled position and the side A is shown folded inwardly over the base in its collapsed condition. In the bottom left hand quadrant of FIG. 2 both the sides A and B are shown collapsed.

Figure 3:
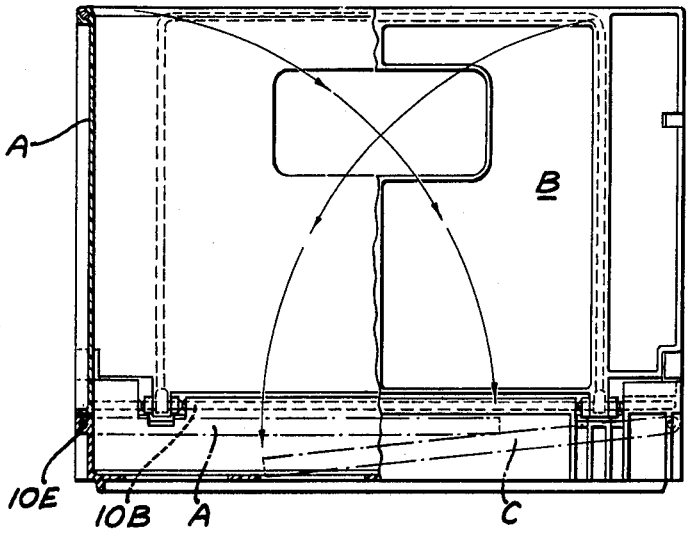
FIG. 3 is a cross-section on the line III—III in FIG. 2.
Figure 4:
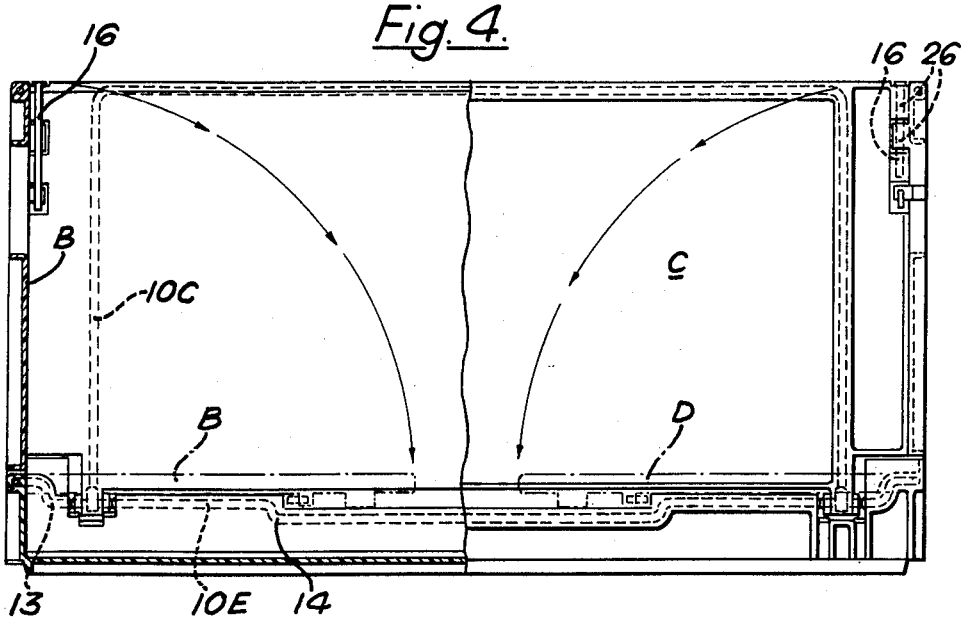
FIG. 4 is a cross-section on the line IV—IV in FIG. 2.

In FIGS. 2, 3 and 4 the positions of the reinforcing elements 10 are shown in dotted lines where appropriate. FIG. 3 indicates generally the positions occupied by the sides A and C and it can be seen clearly that by raising the reinforcing element 10E from the lowest part of the base E of the container and by cranking the reinforcement elements 11 of the base the sides A and C can be housed in the lower part of the container below the hinge axes of the sides B and D. The collapsed position of the sides A and C are shown in chain-dotted lines.

FIG. 4 shows in chain-dotted lines the positions occupied by the sides B and D after folding in of the sides A and C. It can be seen that the sides B and D lie in alignment with another so that when the crate is inwardly collapsed it is substantially flat. Furthermore, the sides B and D and the base contain complementary profiled sections to enable one collapsed container to nest with another below it.

Figure 5:
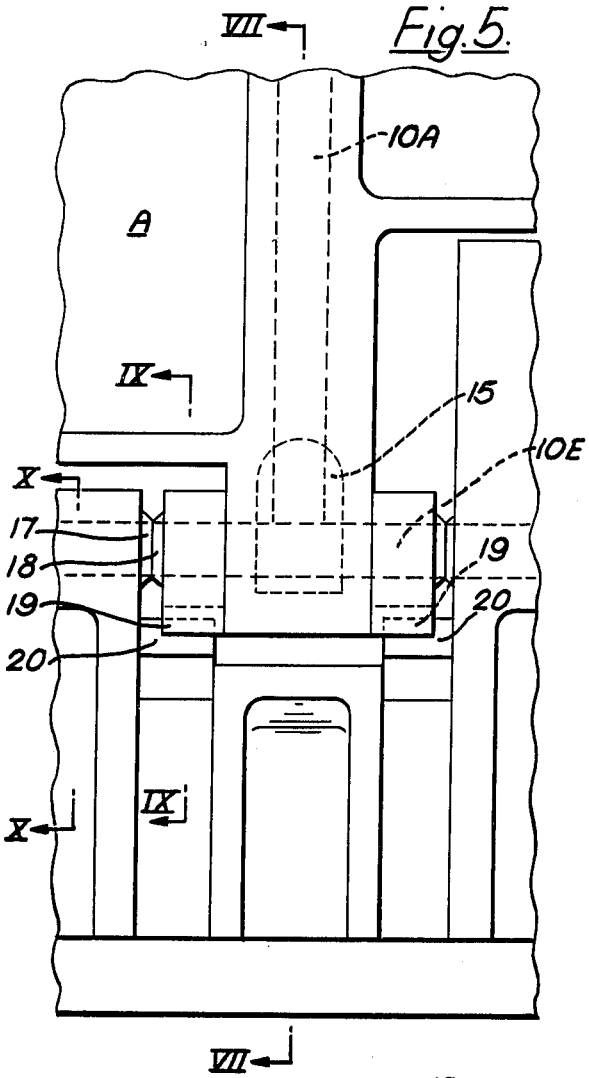
FIG. 5 is an enlarged view showing detail of one of the hinge points on the container.

FIG. 5 illustrates in detail the arrangement of one of the hinges, for example between the side A and the base E. The reinforcing elements shown in dotted lines as indicated. The thermoplastic material is moulded around the reinforcing elements in such a way that on either side of each hinge point a V-shaped annular recess is formed extending substantially to the surface of the reinforcing element so that on moving the side A upwards from its moulded position into its assembled position a shearing action shears the thin web of plastics material which still surrounds the reinforcement 10 E to enable movement of the side relative to the base. By having a V-shaped recess conical portions 17 and 18 are formed which cover the reinforcement 10 E to ensure that there is as little ingress of dirt and moisture as possible.

Figure 6:
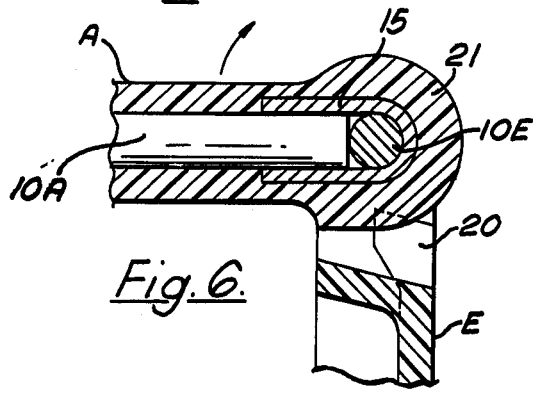
FIG. 6 is a section on the VII—VII in FIG. 5 with the side in its moulded position.

On either side of the hinge point defined by the flat U-shaped element 15 complementary protrusions 19 and 20 are formed in the plastics material during moulding, on the side A and the base E. FIG. 6 shows the initial position of the side A relative to the base E, the thermoplastic material being indicated by the reference numeral 21 in this Figure and the other corresponding sections.

Figure 7:
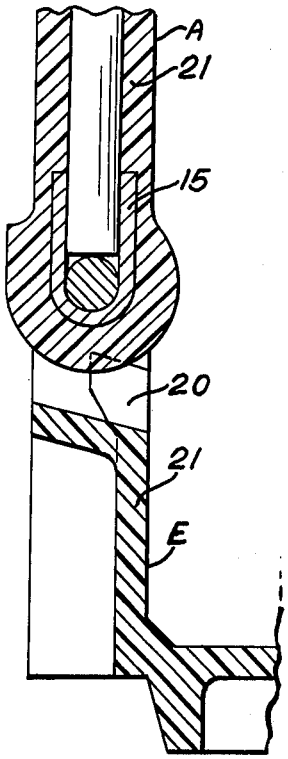
FIG. 7 is a section on the line VII—VII in FIG. 5 with the side in its in-use position.
Figure 8:
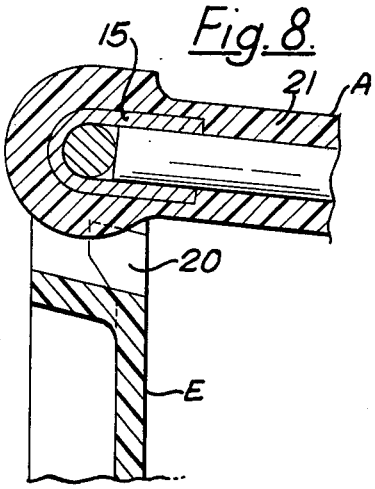
FIG. 8 is a section on the line VII—VII.
Figure 9:
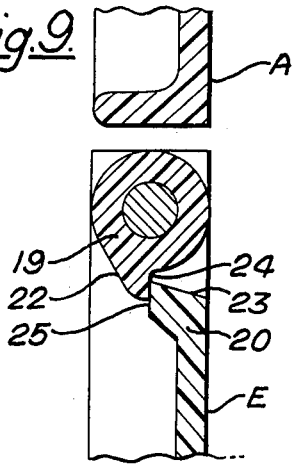
FIG. 9 is a section on the line IX—IX in FIG. 5.
Figure 10:
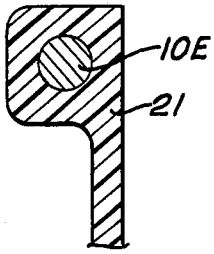
FIG. 10 is a section on the line X—X in FIG. 5.

As the side A is folded up as indicated by the arrow in FIG. 6 into the position shown in FIG. 7 ramp surfaces 22 and 23 on the respective protrusions 19 and 20 contact one another and, resiliently, snap past one another when the upright position of the side A is reached. Abutting surfaces 24 and 25 on the side A and base E respectively, and shown in FIG. 9, abut against one another to prevent the return of the side A into its initial moulded position. However, the abutments do not hinder further movement of the side A into its folded-in position which is shown in FIG. 8. The protrusions 19 and 20 therefore form an interlock preventing collapsing of the container outwardly after initial folding up of the sides of the container, but allowing inward folding of the sides to the collapsed or folded-in position.

Figure 11:
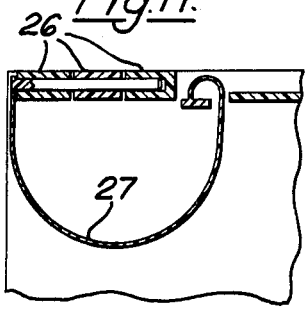
FIG. 11 is a section on the line XI—XI in FIG. 2.

FIG. 11 illustrates in detail one of the elongate studs 16 when positioned through aligned housing parts 26 on two of the sides. The top right hand corner of FIG. 4 also illustrates the way in which the stud holds the sides together. The stud 16 can be moulded integrally with the remainder of the plastics material of the container, or it may be a separate element. If it is moulded integrally it may be retained with the container permanently by a flexible integral strap 27.

FIGS. 13 and 14 illustrate a modified type of hinge in which the end of a side reinforcing element, for example 10A is flattened and bent around the base reinforcement element 10E in the form of a hook as clearly shown in FIG. 14.

I claim:

1. A collapsible container having a base and sides moulded from a synthetic plastics material, said base and said sides including, at least partially encapsulated therein during moulding, elongate metal reinforcing elements, said reinforcing elements in said sides engaging with those in said base to provide integral hinges therebetween, and said container having interlock means at said hinges, said interlock means being adapted such that when, after initial moulding of said container base and sides in a generally flat condition, said sides are folded-up, said interlock means prevent return of said sides to said flat condition whereby said container may thereafter be collapsed only by folding said sides inwardly over said base.

2. A container according to claim 1, wherein said interlock means comprise complementary protrusions of plastics material, said protrusions having inclined ramp surfaces for engaging with one another during folding-up of said sides, and abutment surfaces adapted to engage after folding-up of said sides to prevent folding of said sides back into said flat condition.

3. A container according to claim 1, wherein said reinforcing elements of said base form a rectangular loop, and said reinforcing elements of each of said sides form a substantially rectangular U-shape.

4. A container according to claim 3, wherein free ends of each of said U-shaped side reinforcement abut a respective side of said rectangular loop reinforcement of said base and wherein U-shaped flat elements are welded to said free ends of said side reinforcements, said reinforcement loop of said base extending through said U-shaped elements, whereby said side reinforcements are hinged to said base reinforcements.

5. A container according to claim 1, wherein said reinforcing elements are formed of steel.

6. A container according to claim 1, the container having four sides and a base and wherein one pair of opposed sides of said container are hinged to said base about axes which are non-planar with the hinge axes of said two other opposed sides of container, whereby said first pair of opposed sides can be folded-in below said second opposed sides for compactness.

* * * * *